US011713938B2

(12) United States Patent
Guiffrida

(10) Patent No.: US 11,713,938 B2
(45) Date of Patent: Aug. 1, 2023

(54) BOW

(71) Applicant: Samuel L. Guiffrida, Wrightwood, CA (US)

(72) Inventor: Samuel L. Guiffrida, Wrightwood, CA (US)

( * ) Notice: Subject to any disclaimer, the term of this patent is extended or adjusted under 35 U.S.C. 154(b) by 0 days.

(21) Appl. No.: 18/046,223

(22) Filed: Oct. 13, 2022

(65) Prior Publication Data

US 2023/0113313 A1 Apr. 13, 2023

Related U.S. Application Data

(63) Continuation of application No. 17/344,608, filed on Jun. 10, 2021, now abandoned, which is a continuation of application No. 16/727,622, filed on Dec. 26, 2019, now abandoned.

(60) Provisional application No. 62/785,547, filed on Dec. 27, 2018.

(51) Int. Cl.
*F41B 5/00* (2006.01)
*F41B 5/14* (2006.01)

(52) U.S. Cl.
CPC ..... *F41B 5/0094* (2013.01); *F41B 5/1403* (2013.01)

(58) Field of Classification Search
CPC ..... F41B 5/00; F41B 5/0005; F41B 5/0015; F41B 5/0052; F41B 5/0063; F41B 5/0068; F41B 5/0094; F41B 5/1403
USPC ..... 124/23.1, 25.6, 86
See application file for complete search history.

(56) References Cited

U.S. PATENT DOCUMENTS 1,960,477 A * 5/1934 Cowdery ..... F41B 5/0005 124/90
3,850,156 A * 11/1974 Eicholtz ..... F41B 5/0015 273/DIG. 7
3,965,883 A * 6/1976 Meyer ..... F41B 5/0094 124/90
4,122,821 A * 10/1978 Mamo ..... F41B 5/0052 124/23.1
4,712,533 A * 12/1987 Cruise ..... F41B 5/0063 273/DIG. 7
5,657,739 A * 8/1997 Smith ..... F41B 5/10 273/DIG. 7
5,718,212 A * 2/1998 Allshouse ..... F41B 5/0063 124/23.1
6,105,564 A * 8/2000 Suppan ..... F41B 5/0005 124/23.1
6,536,421 B1 * 3/2003 Jenkins ..... F41B 5/0073 124/23.1

(Continued)

*Primary Examiner* — Alexander R Niconovich
(74) *Attorney, Agent, or Firm* — Stetina Brunda Garred and Brucker

(57) ABSTRACT

A bow includes a handle and upper and lower limbs. The upper and lower limbs are formed of a laminated fiber-reinforced plastic material. The upper limb has first and second sets of fiber sheets stacked in a direction along a lateral axis. The first set of fiber sheets have fibers aligned at a first angle from a longitudinal axis, and the second set of fiber sheets having fibers aligned at a second angle from the longitudinal axis in an opposite direction. The lower limb has third and fourth sets of fiber sheets stacked in a direction along the lateral axis. The third set of fiber sheets have parallel fibers aligned at a third angle from the longitudinal axis, and the fourth set of fiber sheets having fibers aligned at a fourth angle from the longitudinal axis in an opposite direction. The angles are between 16 and 44 degrees.

20 Claims, 7 Drawing Sheets

(56) References Cited

U.S. PATENT DOCUMENTS

| | | | | |
|---|---|---|---|---|
| 6,718,962 | B2 * | 4/2004 | Adcock | F41B 5/0073 124/23.1 |
| 8,635,994 | B1 * | 1/2014 | Yehle | F41B 5/0068 124/23.1 |
| 8,851,056 | B2 * | 10/2014 | Trpkovski | F41B 5/123 124/25 |
| 9,091,503 | B2 * | 7/2015 | Howard | F41B 5/10 |
| 9,322,608 | B2 * | 4/2016 | Painter | F41B 5/0052 |
| 10,627,185 | B2 * | 4/2020 | Marriott | F41B 5/123 |
| 11,143,483 | B2 * | 10/2021 | Marriott | F41B 5/1403 |
| 11,428,496 | B2 * | 8/2022 | Marriott | F41B 5/12 |
| 2002/0029773 | A1 * | 3/2002 | Park | F41B 5/0063 124/23.1 |

* cited by examiner 30
10"
10'
28
60
6
34
6
32
24
10
62
26
22
20
48
50
46

28
66
22
16
64
18
20

BOW

CROSS-REFERENCE TO RELATED APPLICATIONS

This application is a continuation of U.S. patent application Ser. No. 17/344,608, filed Jun. 10, 2021, which is a continuation of U.S. patent application Ser. No. 16/727,622, filed Dec. 26, 2019, which claims the benefit of U.S. Provisional Application Ser. No. 62/785,547, filed Dec. 27, 2018, the contents of which are expressly incorporated herein by reference.

STATEMENT RE: FEDERALLY SPONSORED RESEARCH/DEVELOPMENT

Not Applicable

BACKGROUND

1. Technical Field

The present invention relates in general to a bow, and more particularly, to bow having upper and lower bow limbs formed of a fiber reinforced material.

2. Related Art

A bow consists of a semi-rigid but elastic arc with a high-tensile modulus bowstring joining the ends of the two bow limbs of the bow. Archery bows typically have a rigid stationary handle and flexible bow limbs that bend when the bow is drawn. There are many different types of bows which include but not limited to recurve bows, long bows, compound bows, lever bows and crossbows. The bowstring that is attached to the flexible limbs is drawn back to deform the limbs storing potential energy. When the bowstring is released, the limbs act like springs and return the bowstring back to its undrawn position.

Bow limbs are constructed out of one material or several, as in a composite. Different types of materials for bow limbs can vary from manufacturer to manufacture. The types of materials used in bow limb construction include but not limited to metal, fiberglass, carbon fiber and wood. Using the previous listed materials, bow limbs can be built or formed of solid monolithic or sandwich method consisting of two opposite face-sheets with a core in between.

All previous methods and types of constructive bow limbs generate potential energy when an archer draws back the bow. Potential energy is the calculated area under the measured force draw curve of the bow. The force draw curve of the bow is created by measuring per inch of drawing the bowstring the force required. Increasing the potential energy will increase the kinetic energy of the released arrow from bow. There have been many advancements on the construction of a bow that has a higher potential energy input which include but not limited to bow limb shape and a mechanical cam attached to each bow limbs. Modern day bowyers face the challenge of how to increase the potential energy input in a bow limb so that there is more output of kinetic energy.

In view of the foregoing, there is a need in the art for an improved bow design.

BRIEF SUMMARY

According to an aspect of the invention, there is provided a bow. The bow includes an elongate handle defining a longitudinal axis, a lateral axis, and a transverse axis. The longitudinal axis and the lateral axis define a bow plane. The handle defines a bow front side and an opposing bow rear side. The handle has an upper handle portion and a lower handle portion. The bow further includes an upper limb having an upper limb tip, an upper limb base and an upper limb body disposed between the upper limb tip and the upper limb base. The upper limb extends from the handle with the upper limb base attached to the upper handle portion within the bow plane. The upper limb is formed of a laminated fiber-reinforced plastic material having first and second sets of fiber sheets stacked in a direction along the lateral axis. The first set of fiber sheets has parallel fibers aligned at a first angle from the longitudinal axis in a direction toward the transverse axis on a first side of the bow plane. The second set of fiber sheets has parallel fibers aligned at a second angle from the longitudinal axis in a direction toward the transverse axis on a second side of the bow plane. The first and second angles are between 16 and 44 degrees. The bow further includes a lower limb has a lower limb tip, a lower limb base and a lower limb body disposed between the lower limb tip and the lower limb base. The lower limb extends from the handle opposite the upper limb with the lower limb base attached to the lower handle portion within the bow plane. The lower limb is formed of a laminated fiber-reinforced plastic material having third and fourth sets of fiber sheets stacked in a direction along the lateral axis. The third set of fiber sheets has parallel fibers aligned at a third angle from the longitudinal axis in a direction toward the transverse axis on the first side of the bow plane. The fourth set of fiber sheets has parallel fibers aligned at a fourth angle from the longitudinal axis in a direction toward the transverse axis on the second side of the bow plane. The third and fourth angles are between 16 and 44 degrees.

According to various embodiments, the upper limb body may have a Poison's ratio of greater than 0.75 and the lower limb body may have a Poison's ratio of greater than 0.75. The bow may further include a bowstring extending between the upper limb tip and the lower limb tip. The bowstring has a center portion intersecting the lateral axis. The bowstring is straight adjacent the center portion with the bow in an undrawn configuration. In a full drawn configuration the center portion is positioned along the lateral axis away from the position of the center portion in the undrawn configuration. In the full drawn configuration the upper and lower limbs may be flexed in a direction along the lateral axis in the bow plane away from the bow front side of the handle, and in the full drawn configuration the upper limb and lower limb may be in tension along the bow front side and in compression along the bow rear side. The upper limb body adjacent the upper handle portion at the bow front side may be anticlastic in the strung to full drawn configuration, and the lower limb body adjacent the lower handle portion at the bow front side may be anticlastic in the strung to full drawn configuration. The first and second angles may be between 20 and 27 degrees, and the third and fourth angles may be between 20 and 27 degrees. The first and second angles may be the same, and the third and fourth angles may be the same. The first, second, third and fourth angles all may be the same.

According to another embodiment of the invention, there is provided a bow. The bow includes an elongate handle defining a defining a longitudinal axis, a lateral axis, and a transverse axis. The longitudinal axis and the lateral axis define a bow plane. The handle defines a bow front side and an opposing bow rear side. The handle has an upper handle portion and a lower handle portion. The bow further includes an upper limb having an upper limb tip, an upper limb base and an upper limb body disposed between the upper limb tip and the upper limb base. The upper limb extends from the handle with the upper limb base attached to the upper handle portion within the bow plane. The upper limb is formed of a laminated fiber-reinforced plastic material having first and second sets of fiber sheets stacked in a direction along the lateral axis. The first set of fiber sheets has parallel fibers aligned at a first angle from the longitudinal axis in a direction toward the transverse axis on a first side of the bow plane. The second set of fiber sheets has parallel fibers aligned at a second angle from the longitudinal axis in a direction toward the transverse axis on a second side of the bow plane. The upper limb body has a Poison's ratio of greater than 0.75. The bow further includes a lower limb has a lower limb tip, a lower limb base and a lower limb body disposed between the lower limb tip and the lower limb base. The lower limb extends from the handle opposite the upper limb with the lower limb base attached to the lower handle portion within the bow plane. The lower limb is formed of a laminated fiber-reinforced plastic material having third and fourth sets of fiber sheets stacked in a direction along the lateral axis. The third set of fiber sheets has parallel fibers aligned at a third angle from the longitudinal axis in a direction toward the transverse axis on the first side of the bow plane. The fourth set of fiber sheets has parallel fibers aligned at a fourth angle from the longitudinal axis in a direction toward the transverse axis on the second side of the bow plane. The lower limb body has a Poison's ratio of greater than 0.75.

According to various embodiments, the first and second angles may be between 16 and 44 degrees, and the third and fourth angles may be between 16 and 44 degrees. The bow may further include a bowstring extending between the upper limb tip and the lower limb tip. The bowstring has a center portion intersecting the lateral axis. The bowstring is straight adjacent the center portion with the bow in an undrawn configuration. In a full drawn configuration the center portion is positioned along the lateral axis away from the position of the center portion in the undrawn configuration. In the full drawn configuration the upper and lower limbs may be flexed in a direction along the lateral axis in the bow plane away from the bow front side of the handle, and in the full drawn configuration the upper and lower limb may be in tension along the bow front side and in compression along the bow rear side. The upper limb body adjacent the upper handle portion at the bow front side may be anticlastic in the strung to full drawn configuration, and the lower limb body adjacent the lower handle portion at the bow front side may be anticlastic in the strung to full drawn configuration. The first and second angles may be between 20 and 27 degrees, and the third and fourth angles may be between 20 and 27 degrees. The first and second angles may be the same, and the third and fourth angles may be the same. The first, second, third and fourth angles all may be the same.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of certain embodiments of an undermount drawer slide and related method of forming the same, and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 1:
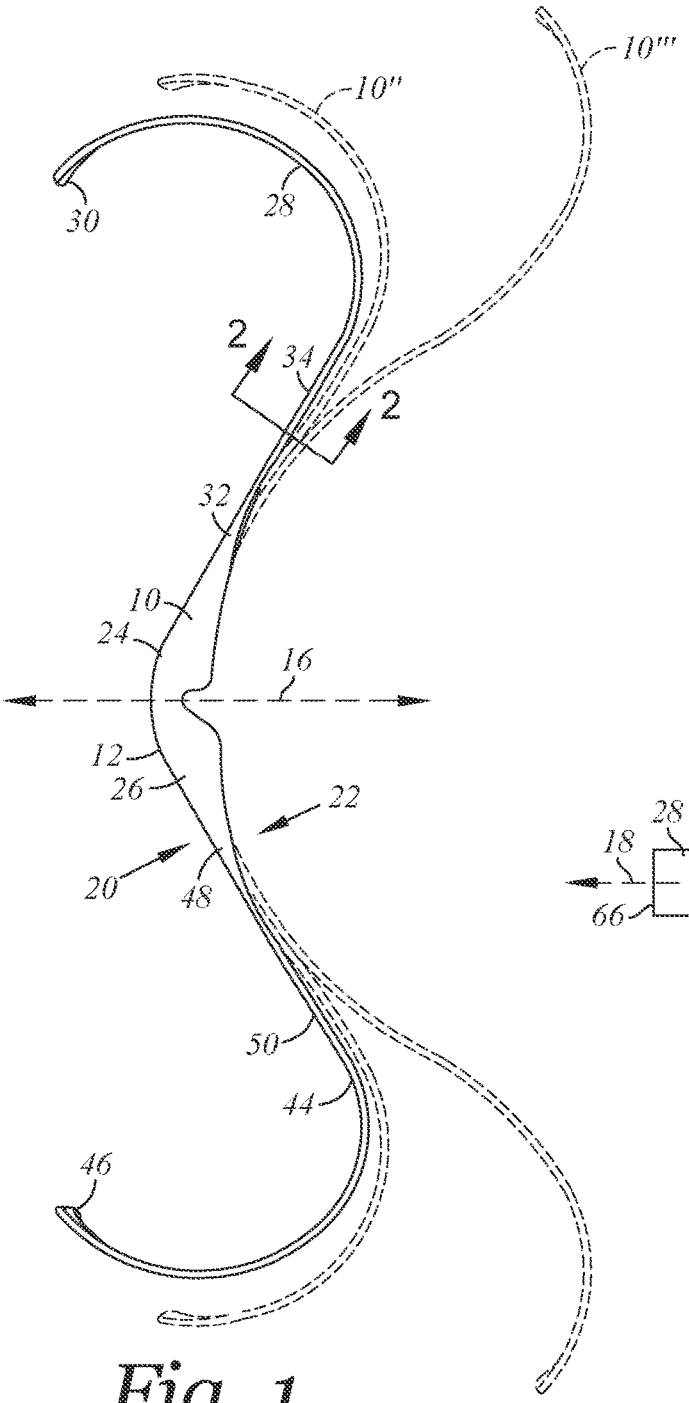
FIG. 1 is a side view of a bow of an embodiment of the present invention in an unstrung configuration with the bow in a strung configuration (drawn in phantom lining) and in a drawn configuration (drawn in phantom lining)
Figure 2:
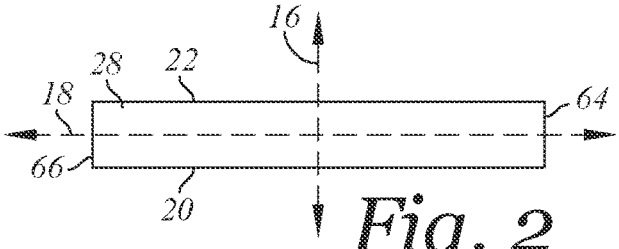
FIG. 2 is a cross-sectional view of a portion of an upper limb of the bow in an unstrung configuration of FIG. 1 as viewed along axis 2-2.
Figure 3:
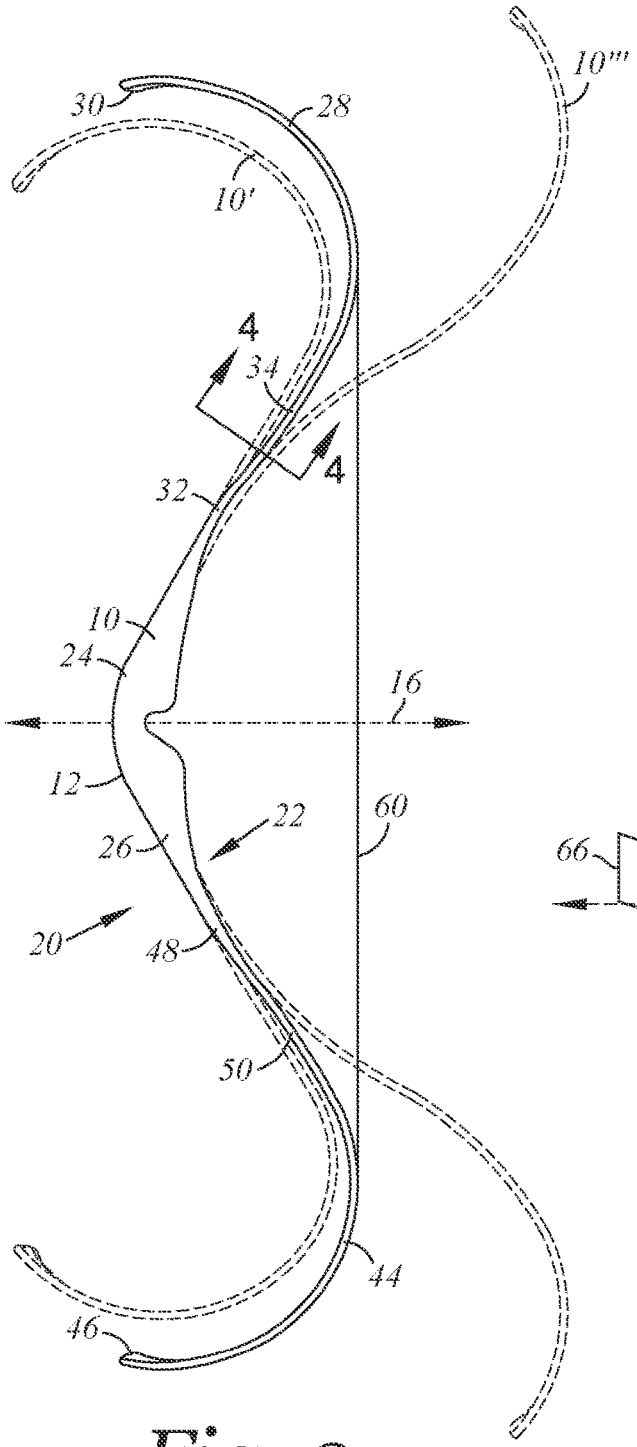
FIG. 3 is a side view of the bow of FIG. 1 in a strung configuration with a bowstring with the bow in an unstrung configuration (drawn in phantom lining) and in a drawn configuration (drawn in phantom lining)
Figure 4:
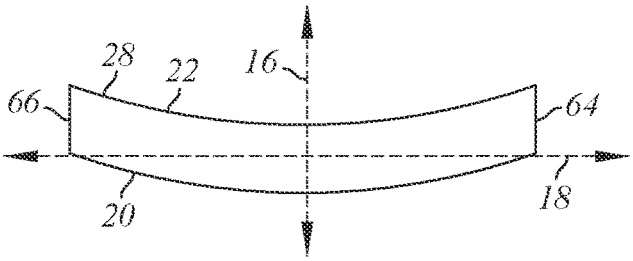
FIG. 4 is a cross-sectional view of a portion of the upper limb of the bow in a strung configuration of FIG. 3 as viewed along axis 4-4.
Figure 5:
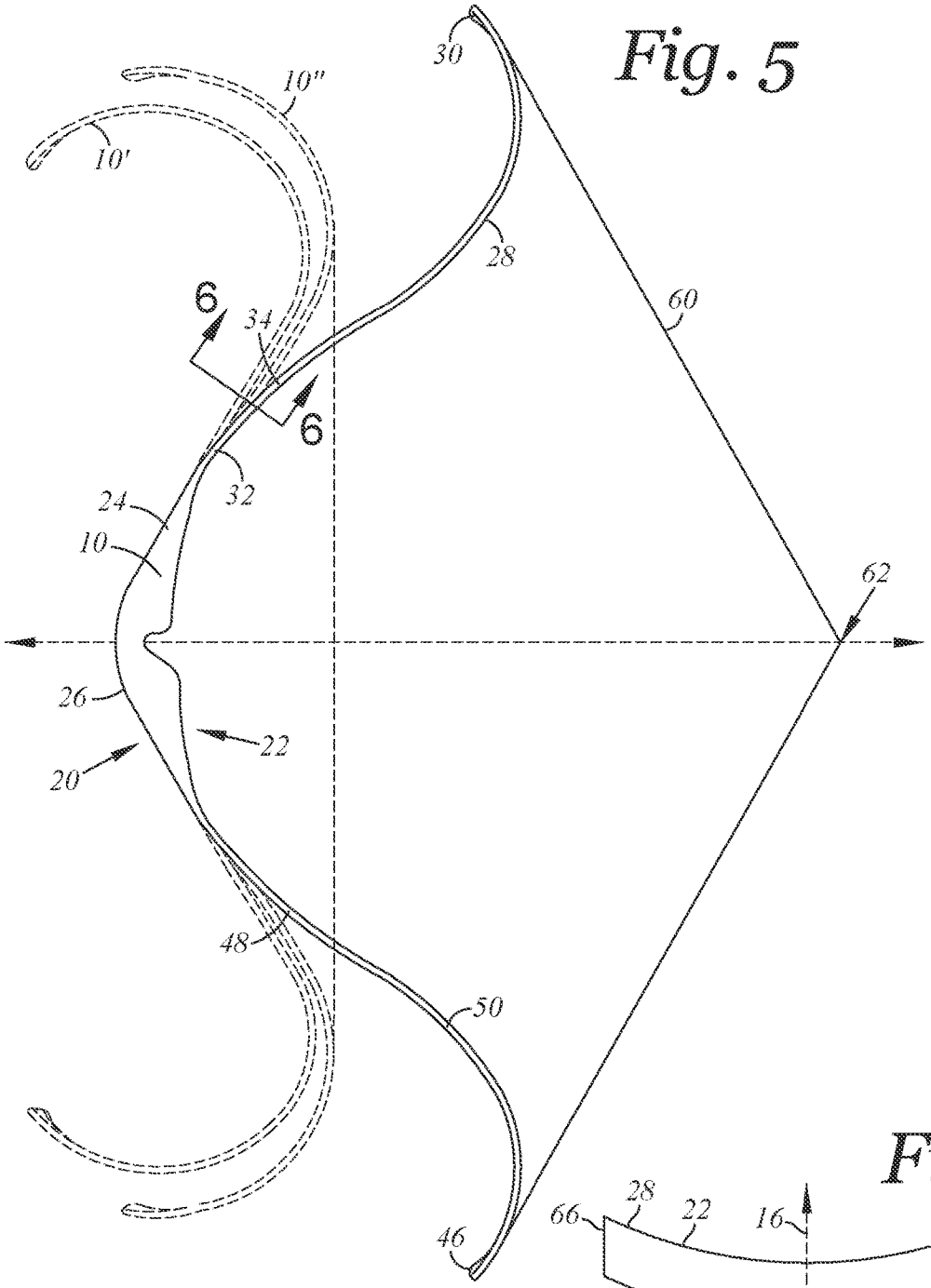
FIG. 5 is a side view of the bow of FIG. 3 in a drawn configuration with the bow in an unstrung configuration (drawn in phantom lining) and in a strung configuration (drawn in phantom lining)
Figure 6:
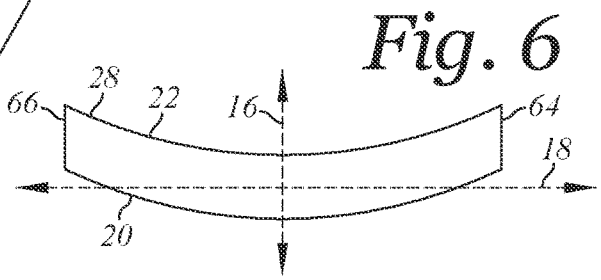
FIG. 6 is a cross-sectional view of a portion of the upper limb of the bow in a full drawn configuration of FIG. 5 as viewed along axis 6-6.

According to an aspect of the invention, there is provided a bow 10. FIG. 1 is a side view of the bow of an embodiment of the present invention in an unstrung configuration with the bow 10 in a strung configuration (drawn in phantom lining, denoted as 10") and in a drawn configuration (drawn in phantom lining, denoted as 10'"). FIG. 2 is a cross-sectional view of a portion of an upper limb 28 of the bow 10 of FIG. 1 as viewed along axis 2-2. FIG. 3 is a side view of the bow 10 of FIG. 1 in a strung configuration with a bowstring 60 with the bow 10 in an unstrung configuration (drawn in phantom lining, denoted as 10') and in a drawn configuration (drawn in phantom lining, denoted as 10'''). FIG. 4 is a cross-sectional view of a portion of the upper limb 28 of the bow 10 of FIG. 3 as viewed along axis 4-4. FIG. 5 is a side view of the bow 10 of FIG. 3 in a drawn configuration with the bow 10 in an unstrung configuration (drawn in phantom lining, denoted 10') and in a strung configuration (drawn in phantom lining, denoted 10''). FIG. 6 is a cross-sectional view of a portion of the upper limb 28 of the bow 10 of FIG. 5 as viewed along axis 6-6.

The bow 10 includes an elongate handle 12 defining a defining a longitudinal axis 14, a lateral axis 16, and a transverse axis 18. The longitudinal axis 14 and the lateral axis 16 define a bow plane. The handle 12 defines a bow front side 20 and an opposing bow rear side 22. The handle 12 has an upper handle portion 24 and a lower handle portion 26. The bow 10 further includes the upper limb 28 having an upper limb tip 30, an upper limb base 32 and an upper limb body 34 disposed between the upper limb tip 30 and the upper limb base 32. The upper limb 28 extends from the handle 12 with the upper limb base 32 attached to the upper handle portion 24 within the bow plane.

The upper limb 28 is formed of a laminated fiber-reinforced plastic material having first and second sets of fiber sheets 36, 38 stacked in a direction along the lateral axis 16. The first set of fiber sheets 36 has parallel fibers 40 aligned at a first angle θ from the longitudinal axis 14 in a direction toward the transverse axis 18 on a first side 64 of the bow plane. The second set of fiber sheets 38 has parallel fibers 42 aligned at a second angle θ' from the longitudinal axis 14 in a direction toward the transverse axis 18 on a second side 66 of the bow plane. The first and second angles θ, θ' are between 16 and 44 degrees The bow 10 further includes a lower limb 44 has a lower limb tip 46, a lower limb base 48 and a lower limb body 50 disposed between the lower limb tip 46 and the lower limb base 48. The lower limb 44 extends from the handle 12 opposite the upper limb 28 with the lower limb base 48 attached to the lower handle portion 26 within the bow plane.

The lower limb 44 is formed of a laminated fiber-reinforced plastic material having third and fourth sets of fiber sheets 52, 54 stacked in a direction along the lateral axis 16. The third set of fiber sheets 52 has parallel fibers 56 aligned at a third angle θ'' from the longitudinal axis 14 in a direction toward the transverse axis 18 on the first side 64 of the bow plane. The fourth set of fiber sheets 54 has parallel fibers 58 aligned at a fourth angle θ''' from the longitudinal axis 14 in a direction toward the transverse axis 18 on the second side 66 of the bow plane. The third and fourth angles θ'', θ''' are between 16 and 44 degrees.

Figure 7:
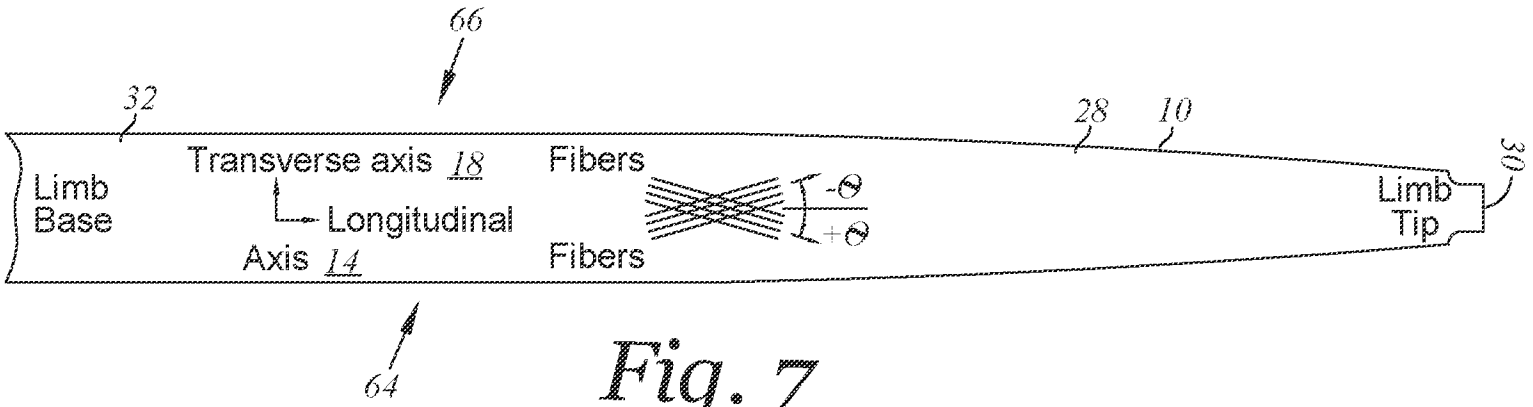
FIG. 7 is a symbolic front view of the upper limb with fiber angles indicated relative to a longitudinal axis and a transverse axis of the bow.
Figure 8:
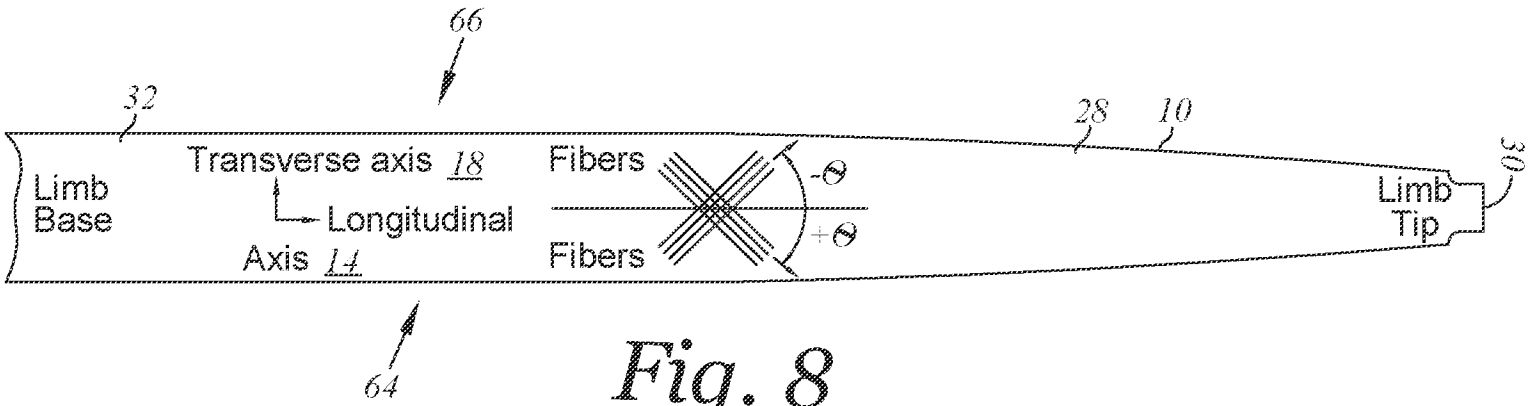
FIG. 8 is a symbolic front view of the upper limb similar to FIG. 8 but with different fiber angles.
Figure 9:
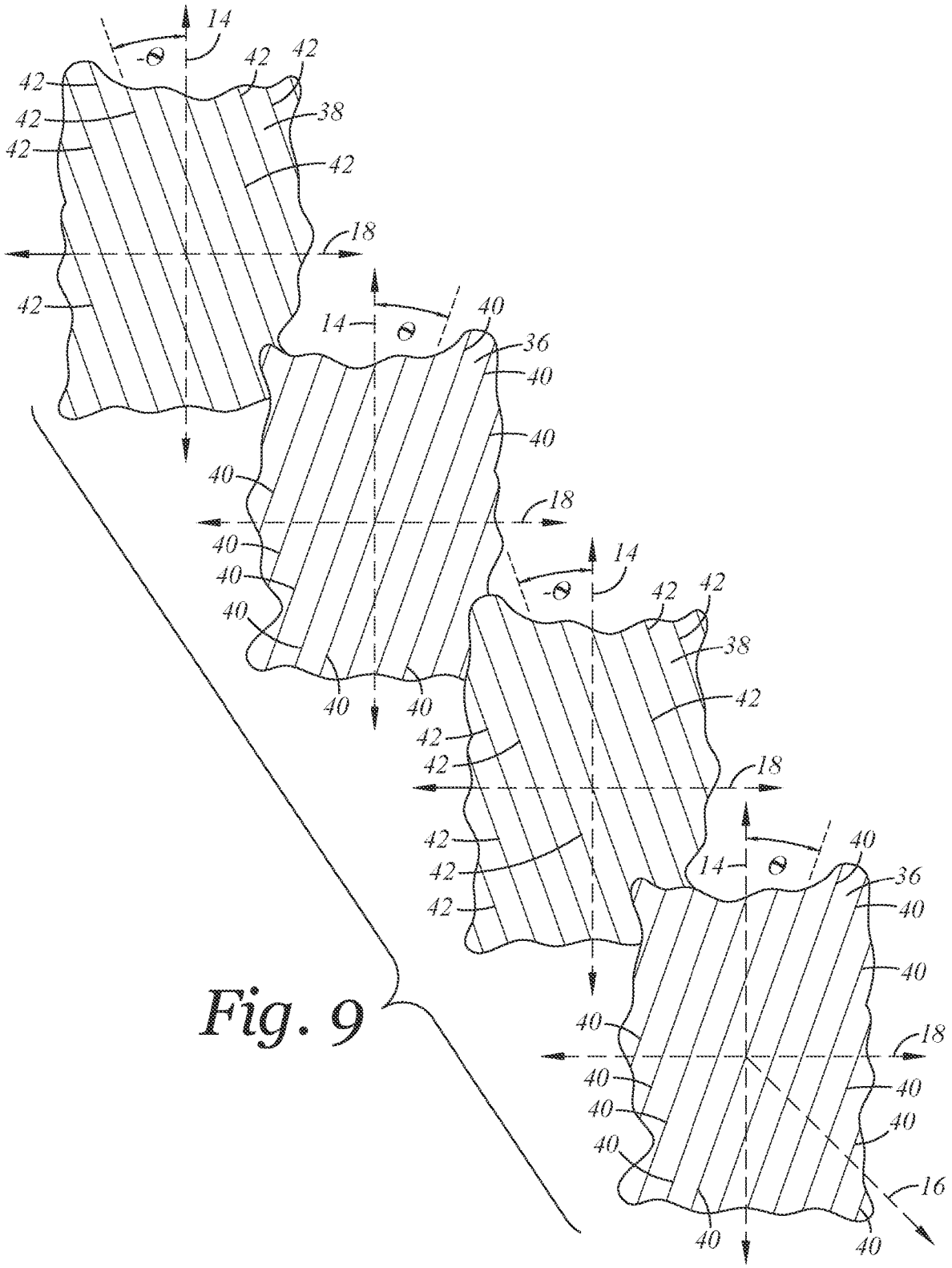
FIG. 9 is a symbolic view of first and second sets of fiber sheets including parallel fibers in each of the sheets at various fiber angles relative to the longitudinal axis and the transverse axis of the bow of the upper limb.
Figure 10:
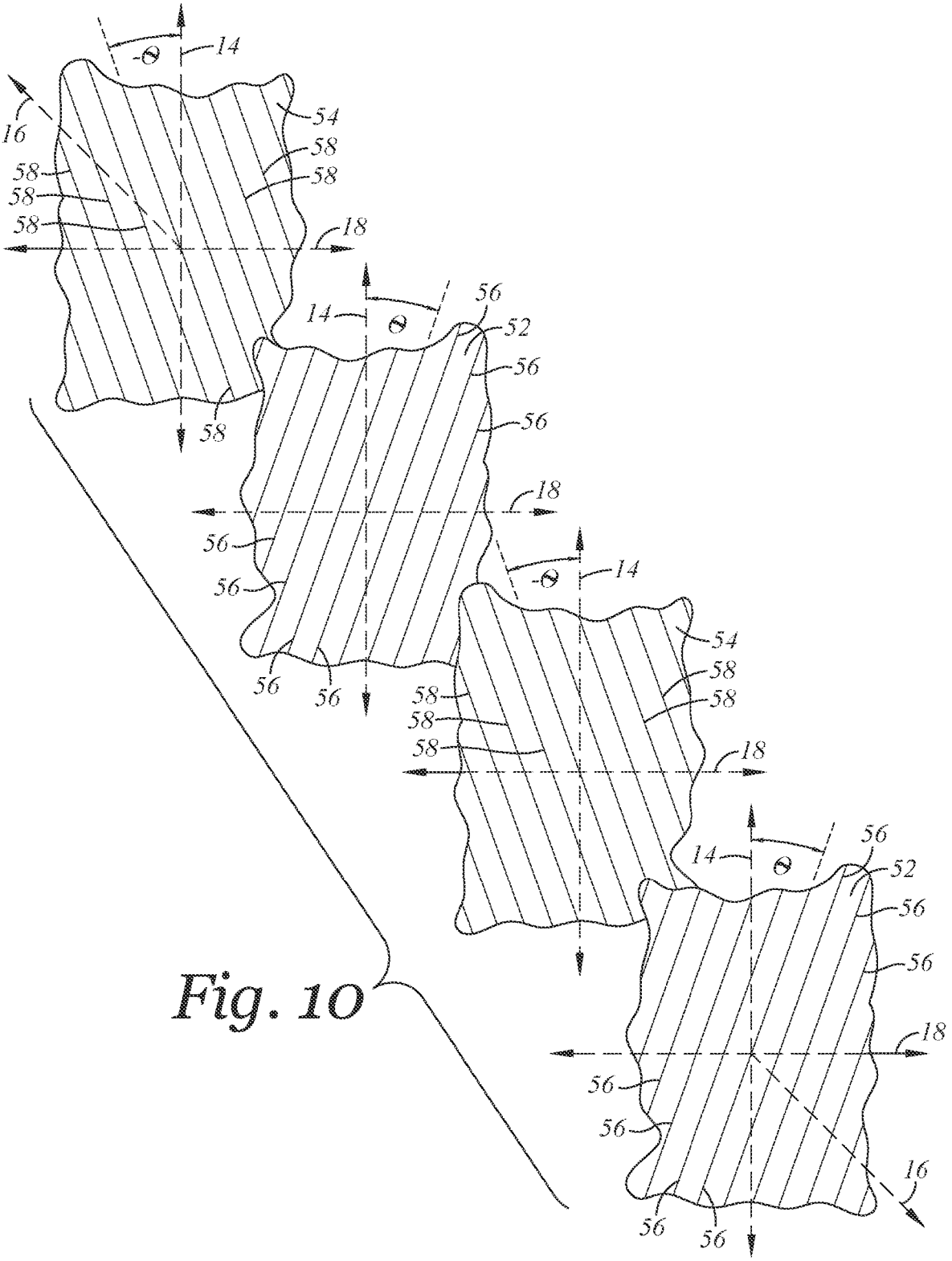
FIG. 10 is a symbolic view of first and second sets of fiber sheets including parallel fibers in each of the sheets at various fiber angles relative to the longitudinal axis and the transverse axis of the bow of a lower limb.

It is contemplated that such fiber angulation results in the upper and lower limbs 28, 44 being anticlastic in nature. In this regard, the shape of the bow front side 20 at upper limb body has a convex curvature with respect to the lateral axis 16 and the transverse axis 18 and has a convex curvature with respect to the longitudinal axis 14 and the lateral axis 16. Referring additionally to FIG. 7, there is depicted a symbolic front view of the upper limb 24 with fiber angles, the first and second angles θ, θ' of about 16 degrees as indicated relative to a longitudinal axis 14 and a transverse axis 18 of the bow 10. FIG. 8 is a symbolic front view of the upper limb similar to FIG. 8 but with different fiber angles, the first and second angles θ, θ' of about 44 degrees. FIG. 9 is a symbolic view of the first and second sets of fiber sheets 36, 38 including the first and second fibers 40, 42. FIG. 10 is a symbolic view of the third and fourth sets of fiber sheets 52, 54 including the third and fourth fibers 56, 58.

The bow 10 may further include the bowstring 60 extending between the upper limb tip 30 and the lower limb tip 46. The bowstring 64 has a center portion 62 intersecting the lateral axis 16. The bowstring 60 is straight adjacent the center portion 62 with the bow 10 in a stung and undrawn configuration as depicted in FIG. 3. With the bowstring 60 stung but with and no external force by archer is applied to bowstring 60, the bow 10 is considered at brace.

As depicted in FIG. 5, in a full drawn configuration the center portion 62 is positioned along the lateral axis 16 away from the position of the center portion 62 in the undrawn configuration. The center portion 62 is the location of the bowstring 60 where an archer would temporarily engage an arrow during use. In the full drawn configuration the upper and lower limbs 28, 44 may be flexed in a direction along the lateral axis 16 in the bow plane away from the bow front side 20 of the handle 12. In the full drawn configuration the archer has reached full draw and maximum forces, moments and torque is applied to the upper and lower limbs 28, 44. In the full drawn configuration the upper limb 28 may be in tension along the bow front side 20 and the lower limb 44 is in compression along the bow rear side 22. The upper limb body 34 adjacent the upper handle portion 24 at the bow front side 20 may be anticlastic in the full drawn configuration, and the lower limb body 50 adjacent the lower handle portion 26 at the bow front side 20 may be anticlastic in the full drawn configuration.

An aspect of the present invention pertains to the recognition that advancing the bow limb mechanical property Poisson's ratio to achieve a dynamic anticlastic curvature of the upper and lower limbs 28, 44 during bending. Poisson's ratio is a measure of the Poisson effect, the phenomenon in which a material tends to expand in directions perpendicular to the direction of compression. Conversely, if the material is stretched rather than compressed, it usually tends to contract in the directions transverse to the direction of stretching. When the upper and lower limbs 28, 44 are bending, the side of the limb facing the archer is in compression (the bow rear side 22) and the opposite side (the bow front side 20) is in tension. Due to the Poisson effect of the upper and lower limbs 28, 44 in bending, as the compression side is compressed it expands perpendicularly and the tension side contracts perpendicularly causing the compression side to convex and tension to concave. This curvature perpendicular to the bending of upper and lower limbs 28, 44 is referred to herein as having an anticlastic curvature. The greater the Poisson's ratio the greater the anticlastic curvature. According to an embodiment, the upper limb body 34 may have a Poison's ratio of greater than 0.75 and the lower limb body 50 may have a Poison's ratio of greater than 0.75.

Another aspect of the present invention pertains to the recognition that orienting the fibers 40, 42, 56, 58 as discussed above may be used to advance the bow limb mechanical property Poisson's ratio to achieve a dynamic anticlastic curvature of the upper and lower limbs 28, 44. It is contemplated that lower Poisson's ratio results in less anticlastic curvature which results in lower increase in dynamic flexural stiffness of the upper and lower limbs 28, 44. A result of lower increase in dynamic flexural stiffness results in less potential energy in the bow 10 and correspondingly less kinetic energy of arrow when the bowstring 60 is released.

An ultra-high Poisson's ratio greatly increases the anticlastic behavior, which in turn increases the bow limb flexural stiffness as bow 10 is drawn. The increase in the bow flexural stiffness increases the potential energy in the bow 10 and yields more kinetic energy of an arrow when it is released from the bow 10. A bow limb with ultra-high, greater than Poisson's Ratio of 0.75, anticlastic curvature will greatly increase the dynamic flexural stiffness of the bow limb and in turn increase the potential energy of the bow limb. The increase in potential energy will increase the kinetic energy of the arrow when bowstring is released. It is contemplated that prior art bows are characterized as having bow limbs with a Poisson's ratio of 0.3 to 0.75. As such the present invention is a significant improvement over the prior art. Having an ultra-high Poisson's Ratio greatly increases the anticlastic behavior. This in turn increases the bow limbs flexural stiffness in a rate dependent of the amount of bow is drawn. Ultra-high Poisson's Ratio greatly increases the anticlastic behavior, which in turn increases the bow limb flexural stiffness as bow is drawn. The increase in the bows flexural stiffness increases the potential energy in the bow and yields more kinetic energy of the arrow when it is released from the bow.

As mentioned above, the first, second, third and fourth angles θ, θ', θ", θ"' may be between 16 and 44 degrees. However, more specifically the first and second angles θ, θ' may be between 20 and 27 degrees, and the third and fourth angles θ", θ"' may be between 20 and 27 degrees. Such angles are contemplated to result in a high anticlastic shape. In addition, it is contemplated that the first and second angles θ, θ' are may be the same, and the third and fourth angles θ", θ"' are may be the same. The first, second, third and fourth angles θ, θ', θ", θ"' all may be the same.

During use, an archer grips the bow 10 by the handle 12, draws bowstring 60 which is attached to ultra-high anticlastic upper and lower limbs 28, 44 at the center portion 62 (the bowstring 60 attach point of an arrow), from brace or the strung configuration as depicted in FIG. 3 to a full drawn configuration as depicted in FIG. 5. During this draw motion and the upper and lower limbs 24, 44 are flexed the geometric cross section of ultra-high anticlastic upper and lower limbs changes as depicted in FIGS. 4 and 6. During use an archer draws bow 10 back to full draw with an arrow attached or engaged with the bowstring 60, storing the potential energy into the upper and lower limbs 24, 44, and then releases the bowstring 60 and launching the arrow.

As mentioned above, the upper limb 28 is formed of a laminated fiber-reinforced plastic material having first and second sets of fiber sheets 36, 38 stacked in a direction along the lateral axis 16. Likewise, the lower limb 44 is formed of a laminated fiber-reinforced plastic material having third and fourth sets of fiber sheets 52, 54 stacked in a direction along the lateral axis 16. Such material is contemplated particularly utilize reinforcing fibers that may be generally aligned along a desired direction. Such fibers may be carbon for example and may be chosen from any of those which are well known to one of ordinary skill in the art. FIG. 9 is a symbolic view of the first and second sets of fiber sheets 36, 38 including the first and second fibers 40, 42. FIG. 10 is a symbolic view of the third and fourth sets of fiber sheets 52, 54 including the third and fourth fibers 56, 58. The symbolic views of FIGS. 9 and 10 depict only two sheets each of the various sheets 36, 38, 52, 54, in practice there bow 10 would include a plurality of sheets of various quantity and thicknesses. Further while the various sheets 36, 38, 52, 54 are depicted on only having fibers in a single direction (unidirectional), additional fibers at other angles may be included, and such sheets may include fibers in multiple directions (such as bi-directional with the fiber directions at equal but opposite 90 degrees to each other). The particular plastic material used for the various sheets 36, 38, 52, 54 may be various types of resins and may be chosen from and formed according to any of those techniques which are well known to one of ordinary skill in the art.

Figure 11:
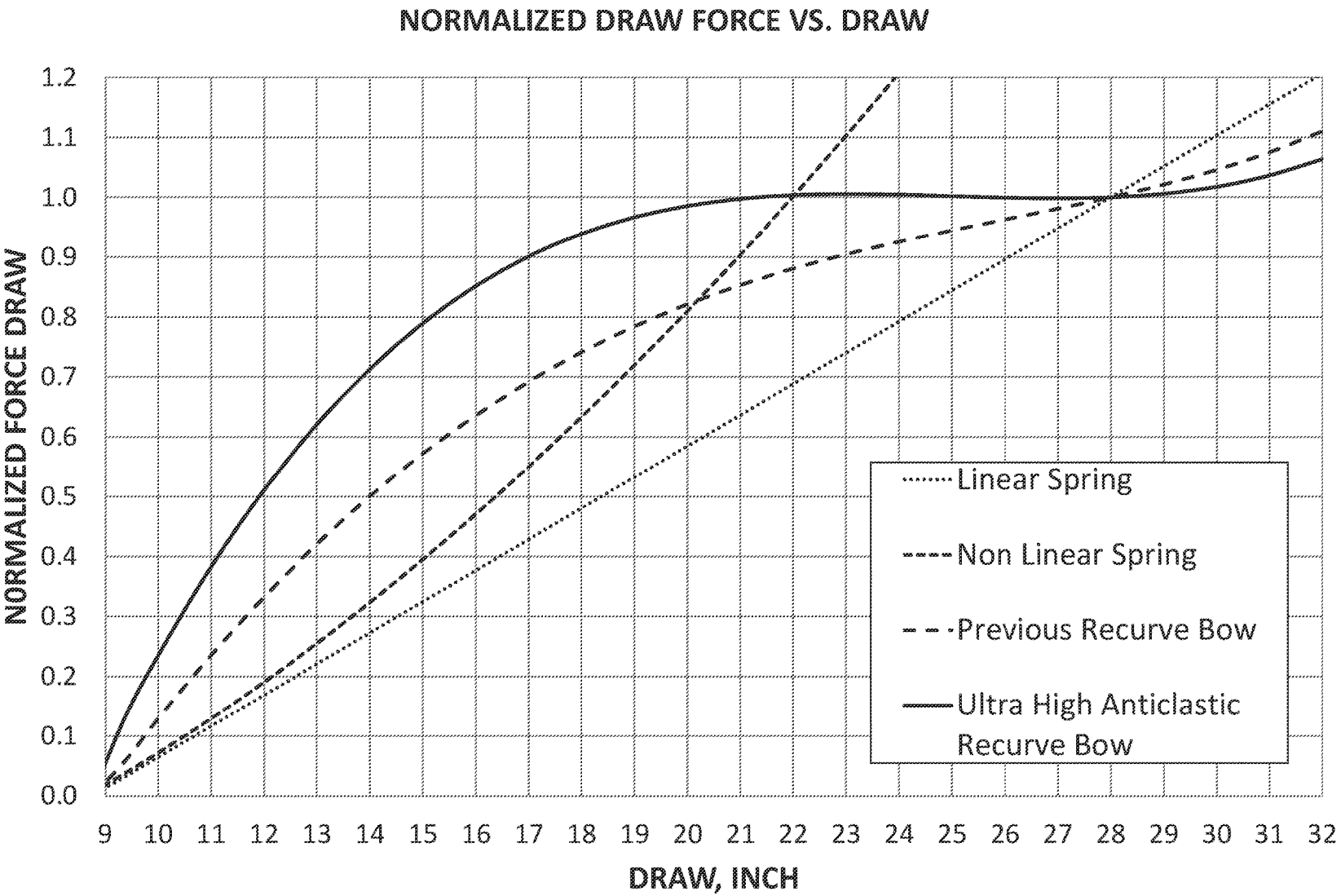
FIG. 11 is an exemplary force draw curve comparison chart.

Referring now to FIG. 11 there is depicted an exemplary force draw curve comparison chart. The chart plots draw force versus draw. The draw is the distance of the center portion 62 of the bowstring along the transverse axis 18. The draw force is the amount of force required to move the center portion 62 to various positions along the transverse axis 18 during the drawing of the bow 10. The indicated draw force is normalized in this chart. Four curves are depicted, a straight-line linear spring, a non-linear spring (both for reference), a prior art or previous recurve bow limbs, and ultra high anticlastic bow limbs, such as associated with the bow 10 of the present invention. As is understood from the relatively high draw force, the non-linear increase of upper and lower limb flexural stiffness due to upper and lower limb geometric cross section shape changing as bowstring 60 is drawn back greatly increases the potential energy in the upper and lower limbs 28, 44 at a rate higher than prior art bow limbs without ultra-high anticlastic behavior.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A bow comprising:

an elongate handle defining a defining a longitudinal axis, a lateral axis, and a transverse axis, the longitudinal axis and the lateral axis defining a bow plane, the handle defining a bow front side and an opposing bow rear side, the handle having an upper handle portion and a lower handle portion;

an upper limb having an upper limb tip, an upper limb base and an upper limb body disposed between the upper limb tip and the upper limb base, the upper limb extending from the handle with the upper limb base attached to the upper handle portion within the bow plane, the upper limb being formed of a laminated fiber-reinforced plastic material having first and second sets of fiber sheets stacked in a direction along the lateral axis, the first set of fiber sheets having parallel fibers aligned at a first angle from the longitudinal axis in a direction toward the transverse axis on a first side of the bow plane, the second set of fiber sheets having parallel fibers aligned at a second angle from the longitudinal axis in a direction toward the transverse axis on a second side of the bow plane, the first and second angles being between 16 and 44 degrees; and a lower limb having a lower limb tip, a lower limb base and a lower limb body disposed between the lower limb tip and the lower limb base, the lower limb extending from the handle opposite the upper limb with the lower limb base attached to the lower handle portion within the bow plane, the lower limb being formed of a laminated fiber-reinforced plastic material having third and fourth sets of fiber sheets stacked in a direction along the lateral axis, the third set of fiber sheets having parallel fibers aligned at a third angle from the longitudinal axis in a direction toward the transverse axis on the first side of the bow plane, the fourth set of fiber sheets having parallel fibers aligned at a fourth angle from the longitudinal axis in a direction toward the transverse axis on the second side of the bow plane, the third and fourth angles being between 16 and 44 degrees;

at least one of the upper limb and the lower limb being configured such that in a reference plane defined by the lateral axis and the transverse axis, the bow front side and the bow rear side are generally parallel in the reference plane when the bow is in an unstrung configuration, and the bow front side assumes a first convex configuration and the bow rear side assumes a first concave configuration in the reference plane when the bow is in a strung configuration, and the bow front side assumes a second convex configuration and the bow rear side assumes a second concave configuration in the reference plane when the bow is in a drawn configuration, a degree of deflection of the bow front side and the bow rear side relative to their respective positions in the unstrung configuration being greater in the drawn configuration than the strung configuration.

2. The bow of claim 1 wherein the upper limb body has a Poisson's ratio of greater than 0.75 and the lower limb body has a Poisson's ratio of greater than 0.75.

3. The bow of claim 1 further includes a bowstring extending between the upper limb tip and the lower limb tip, the bowstring has a center portion intersecting the lateral axis, the bowstring is straight adjacent the center portion with the bow in an undrawn configuration, in a full drawn configuration the center portion is positioned along the lateral axis away from the position of the center portion in the undrawn configuration.

4. The bow of claim 3 wherein in the full drawn configuration the upper and lower limbs are flexed in a direction along the lateral axis in the bow plane away from the bow front side of the handle, in the full drawn configuration the upper limb is in tension along the bow front side and the lower limb is in compression along the bow rear side.

5. The bow of claim 3 wherein the upper limb body adjacent the upper handle portion at the bow front side is anticlastic in the full drawn configuration, and the lower limb body adjacent the lower handle portion at the bow front side is anticlastic in the full drawn configuration.

6. The bow of claim 1 wherein the first and second angles are between 20 and 27 degrees, and the third and fourth angles are between 20 and 27 degrees.

7. The bow of claim 1 wherein the first and second angles are the same, and the third and fourth angles are the same.

8. The bow of claim 1 wherein the first, second, third and fourth angles are the same.

9. A bow comprising:

an elongate handle defining a defining a longitudinal axis, a lateral axis, and a transverse axis, the longitudinal axis and the lateral axis defining a bow plane, the handle defining a bow front side and an opposing bow rear side, the handle having an upper handle portion and a lower handle portion;

an upper limb having an upper limb tip, an upper limb base and an upper limb body disposed between the upper limb tip and the upper limb base, the upper limb extending from the handle with the upper limb base attached to the upper handle portion within the bow plane, the upper limb being formed of a laminated fiber-reinforced plastic material having first and second sets of fiber sheets stacked in a direction along the lateral axis, the first set of fiber sheets having parallel fibers aligned at a first angle from the longitudinal axis in a direction toward the transverse axis on a first side of the bow plane, the second set of fiber sheets having parallel fibers aligned at a second angle from the longitudinal axis in a direction toward the transverse axis on a second side of the bow plane, the upper limb body having a Poisson's ratio of greater than 0.75; and a lower limb having a lower limb tip, a lower limb base and a lower limb body disposed between the lower limb tip and the lower limb base, the lower limb extending from the handle opposite the upper limb with the lower limb base attached to the lower handle portion within the bow plane, the lower limb being formed of a laminated fiber-reinforced plastic material having third and fourth sets of fiber sheets stacked in a direction along the lateral axis, the third set of fiber sheets having parallel fibers aligned at a third angle from the longitudinal axis in a direction toward the transverse axis on the first side of the bow plane, the fourth set of fiber sheets having parallel fibers aligned at a fourth angle from the longitudinal axis in a direction toward the transverse axis on the second side of the bow plane, the lower limb body having a Poisson's ratio of greater than 0.75;

at least one of the upper limb and the lower limb being configured such that in a reference plane defined by the lateral axis and the transverse axis, the bow front side and the bow rear side are generally parallel in the reference plane when the bow is in an unstrung configuration, and the bow front side assumes a first convex configuration and the bow rear side assumes a first concave configuration in the reference plane when the bow is in a strung configuration, and the bow front side assumes a second convex configuration and the bow rear side assumes a second concave configuration in the reference plane when the bow is in a drawn configuration, a degree of deflection of the bow front side and the bow rear side relative to their respective positions in the unstrung configuration being greater in the drawn configuration than the strung configuration.

10. The bow of claim 9 further includes a bowstring extending between the upper limb tip and the lower limb tip, the bowstring has a center portion intersecting the lateral axis, the bowstring is straight adjacent the center portion with the bow in an undrawn configuration, in a full drawn configuration the center portion is positioned along the lateral axis away from the position of the center portion in the undrawn configuration.

11. The bow of claim 10 wherein in the full drawn configuration the upper and lower limbs are flexed in a direction along the lateral axis in the bow place away from the bow front side of the handle, in the drawn configuration the upper limb is in tension along the bow front side and the lower limb is in compression along the bow rear side.

12. The bow of claim 10 wherein the upper limb body adjacent the upper handle portion at the bow front side is anticlastic in the full drawn configuration, and the lower limb body adjacent the lower handle portion at the bow front side is anticlastic in the full drawn configuration.

13. The bow of claim 9 wherein the first and second angles are between 20 and 27 degrees, and the third and fourth angles are between 20 and 27 degrees.

14. The bow of claim 9 wherein the first and second angles are the same, and the third and fourth angles are the same.

15. The bow of claim 9 wherein the first, second, third and fourth angles are the same.

16. A bow comprising:

an elongate handle defining a defining a longitudinal axis, a lateral axis, and a transverse axis, the longitudinal axis and the lateral axis defining a bow plane, the handle defining a bow front side and an opposing bow rear side, the handle having an upper handle portion and a lower handle portion;

an upper limb having an upper limb tip, an upper limb base and an upper limb body disposed between the upper limb tip and the upper limb base, the upper limb extending from the handle with the upper limb base attached to the upper handle portion within the bow plane, the upper limb being formed of a laminated fiber-reinforced plastic material having first and second sets of fiber sheets stacked in a direction along the lateral axis, the first set of fiber sheets having parallel fibers aligned at a first angle from the longitudinal axis in a direction toward the transverse axis on a first side of the bow plane, the second set of fiber sheets having parallel fibers aligned at a second angle from the longitudinal axis in a direction toward the transverse axis on a second side of the bow plane, the first and second angles being between 16 and 44 degrees; and a lower limb having a lower limb tip, a lower limb base and a lower limb body disposed between the lower limb tip and the lower limb base, the lower limb extending from the handle opposite the upper limb with the lower limb base attached to the lower handle portion within the bow plane, the lower limb being formed of a laminated fiber-reinforced plastic material having third and fourth sets of fiber sheets stacked in a direction along the lateral axis, the third set of fiber sheets having parallel fibers aligned at a third angle from the longitudinal axis in a direction toward the transverse axis on the first side of the bow plane, the fourth set of fiber sheets having parallel fibers aligned at a fourth angle from the longitudinal axis in a direction toward the transverse axis on the second side of the bow plane, the third and fourth angles being between 16 and 44 degrees;

at least one of the upper limb and the lower limb being configured such that in a reference plane defined by the lateral axis and the transverse axis, the bow front side and the bow rear side are generally parallel in the reference plane when the bow is in a first configuration, and the bow front side assumes a convex configuration and the bow rear side assumes a concave configuration in the reference plane when the bow is in a second configuration, at least a portion of the upper and lower limbs being moved toward each other as the bow transitions from the first configuration toward the second configuration.

17. The bow of claim 16 wherein the upper limb body has a Poisson's ratio of greater than 0.75 and the lower limb body has a Poisson's ratio of greater than 0.75.

18. The bow of claim 16 further includes a bowstring extending between the upper limb tip and the lower limb tip.

19. The bow of claim 16 wherein the first and second angles are between and 27 degrees, and the third and fourth angles are between 20 and 27 degrees.

20. The bow of claim 16 wherein the first and second angles are the same, and the third and fourth angles are the same.

* * * * *